United States Patent [19]

Elbaum et al.

[11] 4,180,921

[45] Jan. 1, 1980

[54] SPECTACLE FRAME SELECTOR AND DISPLAY DEVICE

[75] Inventors: Bernard M. Elbaum, Pittsford; Engel Harvey, New York, both of N.Y.

[73] Assignee: Textron, Inc., Rochester, N.Y.

[21] Appl. No.: 939,391

[22] Filed: Sep. 5, 1978

[51] Int. Cl.[2] ..... G09B 25/00

[52] U.S. Cl. ..... 35/59; 35/55; 211/13

[58] Field of Search ..... 35/50, 55, 56, 58, 59; 211/13

[56] References Cited

U.S. PATENT DOCUMENTS

| | | | |
|---|---|---|---|
| 1,718,919 | 6/1929 | Fitzgibbon | 35/59 |
| 2,949,683 | 8/1960 | Glover | 35/58 X |
| 3,040,448 | 6/1962 | Paxton | 35/56 |
| 3,125,385 | 3/1964 | Friedman | 35/56 X |
| 3,596.390 | 8/1971 | Scalice | 35/59 X |
| 3,978,594 | 9/1976 | Pulitzer et al. | 35/56 |

*Primary Examiner*—Harland S. Skogquist
*Attorney, Agent, or Firm*—Shlesinger, Fitzsimmons & Shlesinger

[57] ABSTRACT

The device comprises a stand having a display section inclined slightly to the horizontal, and a selector section projecting from the forward edge of the display section. A plurality of narrow recesses are formed in the face of the display section in parallel rows and intersecting columns; and each recess is designed to hold a folded spectacle frame. A plurality of selector strips are mounted for reciprocation in parallel grooves formed in the face of the selector section. Numerals on the face of each strip register one by one with an opening formed in the panel adjacent one end of each strip so that for each different position of a strip a different one of its numerals will be viewable through the associated opening. A spectacle frame selector pad is mounted on the selector section adjacent the selector strips, and has thumb tabs marked for different ranges of numerals that may be displayed by the selector strips. When a thumb tab is selected and lifted to expose a particular section in the pad, the information printed on the pad will suggest which of the displayed spectacle frames is most suitable for an individual having the traits denoted by the positions of the selector strips.

9 Claims, 3 Drawing Figures

SPECTACLE FRAME SELECTOR AND DISPLAY DEVICE

This invention relates to eyewear, and more particularly to a novel display-selector device for assisting one in selecting spectacle frames that are best suited, cosmetically, to one's appearance.

Because spectacle frames have become more and more of a fashion accessory, as well as a functional item, prospective purchasers have encountered more difficulty in selecting from among the wide variety of available frames, the particular frame which will best suit his or her taste and physical attributes. In selecting a spectacle frame consideration should be given to those factors which are likely to affect the appearance of the frame when it is being worn by a person. Such factors include, among other things, the person's hair color, face shape, favorite wardrobe colors, cosmetic preferences, etc. While most purchasers would be aware of such factors that are personal to him or her, the average purchaser has no way of correlating these factors for use in selecting suitable eyewear-i.e., a particular spectacle frame and its associated lenses.

It is in object of this invention, therefore, to provide an improved eyewear selector device which can be used to assist a purchaser in correlating the most important factors which, theoretically, should be considered in the cosmetic selection of eyewear.

Another object of this invention is to provide a novel eyewear selector device, which is operable to provide correlated information which is particularily suited for use in selecting cosmetically appropriate eyewear.

A further object of this invention is to provide a combination spectacle frame display and selector device, which is operable to provide a series of numbers for selecting from tabulated data a particular frame that is apparently most suited to a particular individual's taste and physical appearance.

Still another object of this invention is to provide a novel method for assisting a purchaser in selecting eyeglass frames most suitable for his or her appearance in a cosmetic, rather than optical, sense.

Other objects of the invention will be apparent hereinafter from this specification, and from the recital of the appended claims, particularly when in conjunction with the accompanying drawings.

Figure 1:
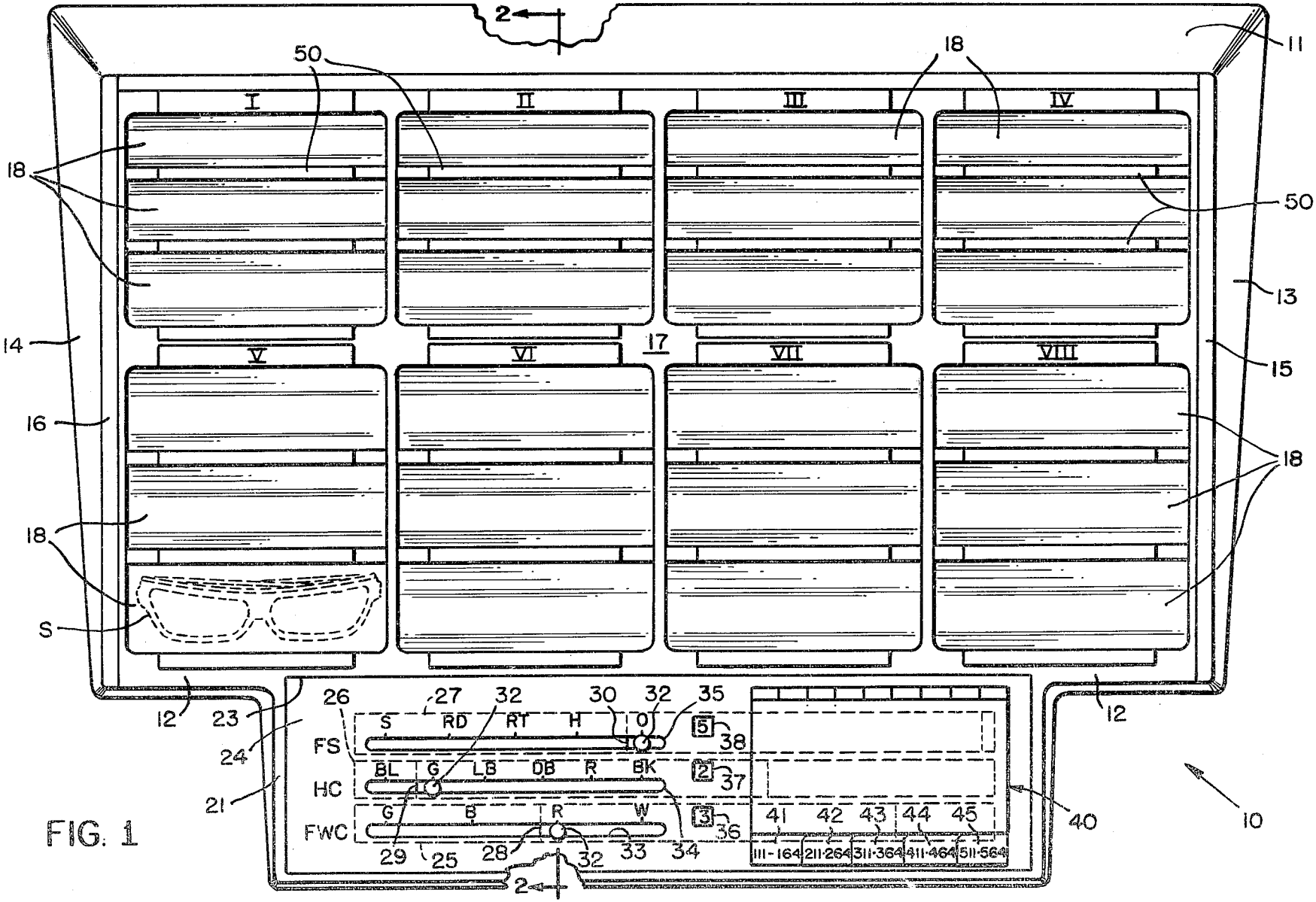
FIG. 1 is a plan view of a combination spectacle frame display and selector device made according to one embodiment of this invention, and showing in phantom by broken lines a spectacle frame positioned in one of the pockets or recepticles formed in the display section of the device.

Referring now to the drawings by numerals of reference, 10 denotes generally a combination spectacle frame display and selector stand, comprising a relatively high rear wall 11, which is inclined slightly to the vertical, a relatively low forward wall 12, which extends generally parallel to wall 11, and a pair of spaced, generally parallel sidewalls 13 and 14, which extend transversely between walls 11 and 12. The upper edges

Figure 2:
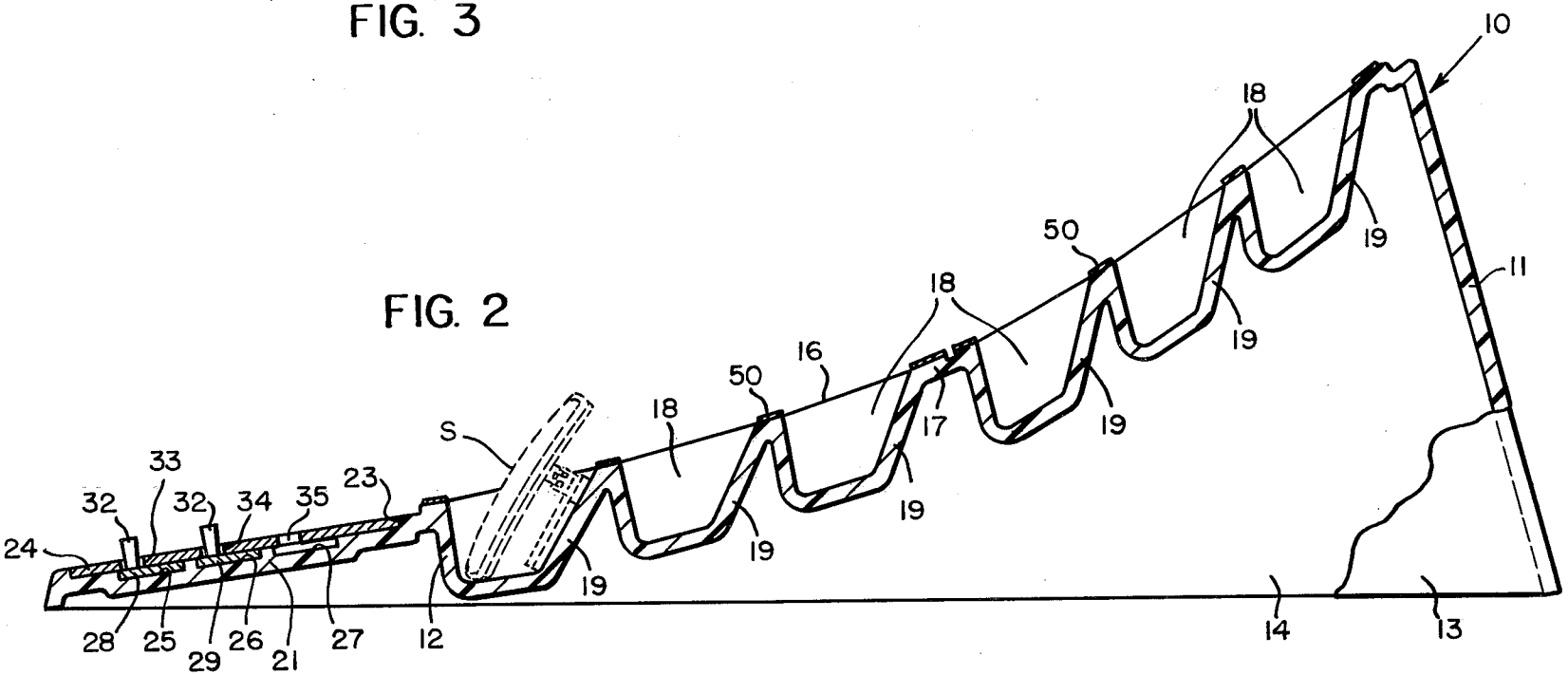
FIG. 2 is a sectional view taken along the line 2—2 in FIG. 1 looking in the direction of the arrows, and again illustrating by broken lines a folded spectacle frame in one of the display receptacles.

15 and 16 of the side walls 13 and 14, respectively are curved gently and concavely intermediate their ends as shown more clearly in FIG. 2, while the lower edges of the side walls lie in a common plane for supporting stand 10 on a horizontal surface.

The upper end of stand 10 is closed by an integral upper wall 17 containing a plurality of spaced recesses or pockets 18, which, when viewed in plan, are arranged in parallel rows that extend transversely between the side walls 13 and 14, and intersecting columns that extend between the front and rear walls of the stand. Each recess 18 is adapted to house a folded spectacle frame, as denoted for example at S in FIGS. 1 and 2. Sections 19 of the wall 17 form the rear or back surfaces of recesses 18, and are inclined to the coplanar lower edges of the side walls 13 and 14 so as normally to support spectacle frames in planes inclined to the horizontal, when the stand 10 is in use.

Integral with the forward wall 12 of the stand, and projecting forwardly and slightly downwardly therefrom as shown in FIG. 2, is a generally plane platform section 21. This section, which is rectangular in configuration when viewed in plan, is slightly narrower than the spectacle frame display portion of the stand 10, as represented by the recessed upper wall 17. Secured in a rectangular recess 23 in the upper surface of section 21 is a rectangular selector panel or plate 24. Mounted for reciprocation in three parallel grooves or recesses 25, 26 and 27, which are formed in the platform section 21 beneath panel 24, are three rectangular selector strips 28, 29, and 30, respectively. Each of these strips has thereon a knob 32, which projects upwardly from adjacent one end of the associated strip (the left end in FIG. 1) through one of three, parallel slots 33,34 and 35, which are formed in the panel 24 to register with portions of the grooves 25, 26, and 27, respectively.

Figure 3:
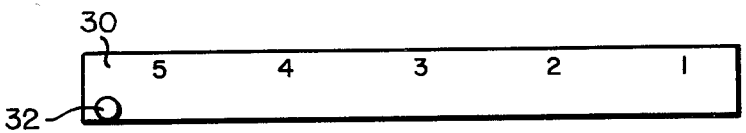
FIG. 3 is a plan view of one of the selector strips, which are mounted for reciprocation in recesses in the selector section of this device.

Printed on the upper surface of each selector strip 28, 29, and 30 in a line which extends parallel with one of the longitutional edges of the strip is a plurality of equispaced digits, which are supposed to register selectively with one of three different windows or openings 36, 37, and 38 that are formed in the panel 24 adjacent the right ends of the slots 33, 34, and 35, respectively. For example, the strip 30 (FIG. 3) has the numerals 5, 4, 3, 2, and 1 printed or otherwise disposed thereon adjacent its upper, longitudional edge, so that when the strip is mounted for sliding movement in groove 27 in platform section 21, these numerals are hidden from view except when the knob 32 on strip 30 is in registery with any one of five different indicator marks, which are marked along the upper edge of the slot 35, and which are designated in FIG. 1 by the letters S, RD, RT, H, and O, respectively. As shown in FIG. 1, when the knob 32 on the strip 30 is in registery with the designation O, the numeral 5, which is imprinted on strip 30 adjacent its upper edge, will then register with the opening 38 in panel 24. Obviously when the strip 30 is moved to position its knob 32 in registery with another of the remaining four designated positions, a different numeral on the face of strip 30 will register with the window 38.

As evidenced by the four designations that are marked at equispaced positions along the upper edge of the slot 33, it is not necessary that each of the strips 28, 29, and 30 have marked thereon the same quantity of numerals. Strip 28, for example, has marked thereon only four equi-spaced numerals, one of which will register with the opening 36 in the panel 24 whenever the strip 28 is in one of the four positions designated by the letters G, B, R, and W, which are marked along the upper edge of the slot 33. Strip 29, on the other hand, is shown to have six different designated positions (BL, G, LB, DB, R, and BK), so of course it would have six different numerals printed along its upper edge for registery selectively with the window 37.

Attached to the upper surface of the panel 24 to the right of the window openings 36, 37 and 38, is an eyewear selector index or tablet which is denoted generally 40 in FIG. 1. This index is divided into five different sections, each of which has a cover page adapted to be manipulated by one of five different thumb tabs 41, 42, 43, 44, and 45, which are positioned in spaced relation to each other adjacent the lower edge of the tablet. Each of these tabs is marked to denote a range of numerals, starting with 111, 211, 311, 411, and 511 for tabs 41, 42, 43, 44, and 45, respectively. The numerals displayed in the windows 38, 37, and 36 (in that order) are used for selecting the respective index tab. For example, as noted in FIG. 1, the numerals 5, 2, and 3 are in registry with the windows 38, 37, and 36, respectively, so that the index tab 45 for the 511 range would be lifted to expose the information which pertains to the code numerals 5, 2, 3. On the other hand, if the numeral which registers with window 38 is the digit 2, then the tab 42 for the range beginning with numerals 211 would be lifted to expose the information corresponding to the numerals then registering with the openings 38, 37, and 36, respectively.

In use, the stand 10 is placed, for example, on a countertop, or on the upper end of a post or the like, to be readily viewable and accessible by a prospective purchaser. The recesses 18 are designed to contain spectacle frames of various configurations and colors; and if desired, the frames may be divided in different groups of three, as denoted for example by the eight different groups or columns of recesses designated in FIG. 1 by the headings I, II, III, IV, V, VI, VII and VIII, respectively. Moreover, the particular color of each frame (persimmon pink, toffee drift, sable, etc.) may be printed on the face of the stand 10 along the lower edge of each recess 18 in the areas denoted at 50 in FIGS. 1 and 2.

Printed on the face of panel 24 adjacent the left end (FIG. 1) of each of slots 33, 34 and 35, are the legends FS (face shape), HC (hair color) and FWC (favorite wardrobe color), respectively. Knowing these three characteristics, a prospective purchaser then manipulates each of the strips 28, 29 and 30 until the associated knobs 32 register with the legends printed along the upper edges of the slots which most nearly describe these particular characteristics. In the case illustrated in FIG. 1, the knob 32 on strip 30 registers with the letter "O", which indicates that the purchaser believes his or her face to be oval in configuration. The knob 32 on strip 29 registers with G, which denotes grey hair; and the knob of strip 28 registers with R, meaning that red is a favorite wardrobe color.

When the strips 28–30 have been moved to their appropriate positions, the numbers thereon then registering with openings 38, 37 and 36 (numerals 523 in FIG. 1) indicate the three digit number which should be looked up in the selector index 40. In the illustrated example, the tab 45 on the index must be lifted to find information relating to the code numbers 523. The information thus turned up in the index will advise the purchaser as to which of the displayed spectacle frames very likely would be most cosmetically suited for her or him.

From the foregoing it will be apparent that the instant invention provides relatively simple and inexpensive means for correlating diverse information which is useful to a purchaser when reaching a decision as to which of a plurality of different spectacle frames would be most suitable, cosmetically speaking, for him or her. The information contained in the selector index 40 is specifically related to the variable data which is provided by manipulation of the strips 28–30. The purchaser need only make three basic decisions (face shape, hair color and favorite wardrobe color), after which the selector can be manipulated to provide the multiple-digit number which is correlated to the data in the index 40.

While the invention has been described in connection with the selection of eyewear it will be apparent to one skilled in the art that it could also be adapted for use in selecting other consumer products in which a number of variables are involved in deciding on a suitable purchase. Moreover, it will be apparent also that this application is intended to cover any such modifications as may fall within the scope of one skilled in the art or the appended claims.

Having thus described our invention, what we claim is:

1. A spectacle frame selector and display device, comprising a stand having thereon a spectacle frame display surface and a spectacle frame selector surface, said display surface having therein a plurality of spaced recesses each of which is adapted to have a spectacle frame releasably seated therein for display purposes, a first plurality of indicia on said display surface adjacent said recesses and identifying the particular types of spectacle frames seated in said recesses, a plurality of selector members adjustably mounted on said stand adjacent one end of said selector surface for movement manually in accordance with particular physical characteristics and/or fashion preferances of an individual into different selector positions in which said members provide information for use in selecting a frame, and a frame selector index mounted on said selector surface adjacent the opposite end thereof and operable manually in accordance with the information derived from said selector members to disclose the indicia which identifies a particular one of said frames most suited cosmetically for said individual.

2. A spectacle frame selector and display device as defined in claim 1, including means guiding said selector members for movement in predetermined, spaced paths on said stand, a second plurality of indicia disposed on said selector surface in spaced groups corresponding in number to the quantity of said selector members, with the indicia of each of said groups being positioned adjacent to, and arranged along the path of movement of, one of said members and representing different descriptions of a physical characteristic or fashion preferance of an individual, and a selector element on each of said selector members registrable selectively with a different one of said descriptions, as represented by the adjacent indicia, each time a respective member is moved to a different selector position along its path of movement.

3. A spectacle frame selector and display device as defined in claim 2, including a third plurality of indicia for providing the information for operating said selector index, and means operative, when said selector members are in selector positions, to display only selected portions of the indicia of said third plurality, said displayed portions constituting the information necessary for operating said selector index.

4. A spectacle frame selector and display device as defined in claim 3, wherein said selector members are mounted for reciprocation in parallel paths on said selector surface, said guiding means includes a slotted panel overlying said members and having therein parallel slots extending parallel to said paths, and overlying portions of said members, and said selector elements extend through said slots in said panel and are manually operable to effect reciprocation of the associated selector members on said selector surface.

5. A spectacle frame selector and display device as defined in claim 4, wherein said third plurality of indicia comprises a series of spaced characters disposed on the surface of each of said selector members, and correlated with the indicia in said selector index, and said panel has therein a plurality of openings, each of which is positioned adjacent one of said slots, and is disposed to register with one of said characters on one of said selector members when the latter is one of its selector positions, whereby the characters registering with said openings provide the information which is used for operating said selector index.

6. A spectacle frame selector and display device as defined in claim 1, wherein the lower edges of said stand are disposed in a common plane, and said display surface is inclined to said common plane, whereby when said lower edges lie in a horizontal plane said display surface will be inclined to the vertical.

7. A spectacle frame selector and display device as defined in claim 1, wherein said stand comprises of pair like, spaced side walls having coplanar lower edges, a rear wall extending transversely between said side walls and inclined to a plane containing said lower edges, a front wall spaced from said rear wall and extending transversely between said side walls, and an upper wall extending between the upper edges of said side, rear and front walls, and having therein said spaced recesses, said rear wall being greater in height than said front wall whereby said upper wall is inclined both to said rear wall and said plane containing said lower edges.

8. A spectacle frame selector and display device as defined in claim 7, wherein said recesses are arranged in parallel rows and intersecting columns in said upper wall.

9. A spectacle frame selector and display device as defined in claim 7, wherein said selector members comprise rectangularly shaped strips mounted for reciprocation in spaced, parallel slots in said selector surface, and each of said members has thereon a plurality of spaced characters disposed to register selectively with an adjacent opening in said display surface upon movement of the strip to one of its selector positions, the characters registering at any moment with the openings in said display surface providing said information used in operating said selector index.

* * * * *